US005549288A

United States Patent [19]

Laubscher

[11] Patent Number: 5,549,288

[45] Date of Patent: Aug. 27, 1996

[54] METHODS FOR BRINGING TOGETHER FOLDED PRODUCTS

[75] Inventor: Hans J. Laubscher, Frankenthal, Germany

[73] Assignee: Heidelberger Druckmaschinen AG, Heidelberg, Germany

[21] Appl. No.: 312,321

[22] Filed: Sep. 26, 1994

[30] Foreign Application Priority Data

Sep. 24, 1993 [DE] Germany ..... 43 32 516.5

[51] Int. Cl.[6] ..... B65H 39/02; B41F 13/64

[52] U.S. Cl. ..... 270/52.14; 270/45

[58] Field of Search ..... 270/54, 58, 45, 270/12, 8, 9, 15, 17, 51; 198/448, 605, 374, 405; 271/9.13

[56] References Cited

U.S. PATENT DOCUMENTS

| | | | |
|---|---|---|---|
| 432,035 | 7/1890 | Goss | 270/58 |
| 432,036 | 7/1890 | Goss | 270/58 |
| 1,793,552 | 2/1931 | Kast | 270/45 X |
| 4,025,065 | 5/1977 | Timson | 270/12 |
| 4,065,117 | 12/1977 | Thorsheim | 270/58 |
| 4,155,133 | 5/1979 | Timson | 198/374 X |
| 4,569,620 | 2/1986 | Lynch | 198/405 X |
| 4,601,462 | 7/1986 | Bowman | 270/12 |
| 4,696,464 | 9/1987 | Gammerler | 271/9.13 X |
| 4,746,107 | 5/1988 | Schneider et al. . | |
| 5,415,385 | 5/1995 | Newsome et al. | 270/58 |

FOREIGN PATENT DOCUMENTS

| | | |
|---|---|---|
| 3410327 | 10/1985 | Germany . |
| 3614263 | 10/1989 | Germany . |

*Primary Examiner*—John E. Ryznic

*Attorney, Agent, or Firm*—Herbert L. Lerner; Laurence A. Greenberg

[57] ABSTRACT

A method for bringing together and stacking folded products which are guided along a given path of motion includes transferring two folded products at a time from a side-by-side arrangement to a stacked position.

17 Claims, 3 Drawing Sheets

METHODS FOR BRINGING TOGETHER FOLDED PRODUCTS

SPECIFICATION

The invention relates to a method for bringing together, in particular stacking, folded products which are guided along a path of motion.

Folders with two separate folding groups for cross-folding products, in particular copies of printed material, are known. One such folder is disclosed in German Patent 36 14 263. A first printed copy, yet held in folding jaws of a folding jaw cylinder in a first folding group is brought into a stacked position with a second printed copy delivered over conveyor lines from the other folding group.

Depending upon the construction, conventional embodiments have relatively great structural heights, long structural lengths, poor accessibility, feeds at various heights, high cost because of double cylinder systems, and complicated drive systems for two groups of cylinders.

It is therefore an object of the invention to provide a method for bringing together products which can be performed relatively simply and economically, with a constructive realization requiring only little effort or expense.

With the foregoing and other objects in view, there is provided, in accordance with the invention, a method for bringing together and stacking folded products which are guided along a given path of motion, which comprises transferring two folded products at a time from a side-by-side arrangement to a stacked position.

In accordance with another mode, the method of the invention includes imparting a loop-the-loop motion to the one folded product so that it comes to be stacked on the other folded product.

In accordance with a further mode, the method of the invention includes imparting a flapping motion to the one folded product so that it comes to be stacked on the other folded product.

In accordance with an added mode, the method of the invention includes, in the course of applying a first inversion motion to one of the folded products, deflecting the one folded product transversely to the given path of motion and above the other of the folded products and, in the course of applying a second inversion motion thereat, deflecting the one folded product back into the direction of the given path of motion and downwardly onto the other folded product.

In accordance with an additional mode, the method of the invention includes transporting the folded products on belt conveyors.

In accordance with yet another mode of the method of the invention, the belt conveyors, respectively, in at least some regions thereof, are formed of two conveyor belts, and the folded products are received between the two conveyor belts and are transported in the thus received position.

In accordance with yet a further mode, the method of the invention includes, in the loop-the-loop motion, lifting the one product arriving from the direction of the given path of motion and transferring it into an upside-down position, wherein it moves counter to the direction of the path of motion, and then, in departing from the upside-down position, applying a downward motion to the one product, and laterally shifting the one folding product in the course of the loop-the-loop motion so as to bring the one folding product from a position thereof adjacent to the other product in the side by side arrangement into a position thereof congruent with that of the other product.

In accordance with yet an added mode, the method of the invention includes applying a flapping-over motion through 180° to the one folding product about a side edge thereof extending in the direction of the given path of motion, so that the one folding product comes to be stacked on the other folding product.

In accordance with yet an additional mode, the method of the invention includes applying a flapping motion to both of the folding products about respective side edges thereof extending in the direction of the given path of motion, so that the folding products are brought congruently into engagement with one another.

In accordance with still another mode, the method of the invention includes applying the flapping motion to each of the folding products through 90°.

In accordance with still a further mode, the method of the invention includes flapping over the erected, mutually engaging folding products jointly into a horizontal position.

In accordance with still an added mode, the method of the invention includes flapping over the erected, mutually engaging folding products jointly through 90°.

In accordance with still an additional mode of the method of the invention, the performance of the first inversion motion includes guiding the one folding product about a first deflector extending transversely to the given path of motion, and the performance of the second inverse motion includes guiding the one folding product about a second deflector extending transversely to the given path of motion In accordance with another mode, the method of the invention includes interposing transport of the one folding product by a transport medium when guiding the one folding product about the first and the second deflectors.

In accordance with a concomitant mode, the method of the invention includes transporting the folding products with a cross-fold thereof directed in or opposite to the direction of the given path of motion.

Thus, in accordance with the invention, two folded products at a time are transferred from a side-by-side arrangement to a stacked position. The products preferably arrive from a folder, in particular each product being provided with a cross-fold, and move along a path of motion to a side-by-side position. The invention accordingly contemplates this side-by-side arrangement, with the folding products from that arrangement being transferred to the stacked position. This can be done during further transport of the folding products, over a very short travel distance. Corresponding devices therefore have only a very short structural length.

Preferably, provision may be made for the one product to come to be stacked on the other product by means of a loop-the-loop motion, or for at least one of the products to come to be stacked on the other product by means of a flapping motion, or for the one product to be deflected in the course of a first inversion motion transversely to the given path of motion to above the other product and thereat, in the course of a further, second inversion motion, to be deflected back into the direction of the given path of motion downwardly onto the other product. To transfer these products from their side-by-side arrangement to the stack position so that they can be further processed together, in particular longitudinally folded, for example, to create the insert for a daily newspaper, they are handled in accordance with the method of the invention.

One of the possibilities according to the invention is to leave the first product in its position, that is, it moves onward only preferably in a straight line, and to guide the other product along a loop-the-loop path, with this path ending above the first product. As the two products then travel their respective paths, they are brought together, so that they can be further processed together.

An alternative possibility is to move the first product with its position unchanged and to flap the other product over on to it so that a stacked position is brought about. In a modification of this method, it is also possible for both products to undergo a "partial flapping motion", so that in this way they come to be stacked one upon the other.

As a further way, according to the invention, of bringing the folding products together, it is also proposed that the one product traverse the given path of motion with its position unchanged, while the other product is deflected twice, each time being inverted. This transfer path in principle has similarities to a loop-the-loop motion, but the loop-the-loop motion is an essentially steadily curved path while, in the case of the double inversion motion, short curved paths are involved, each of which is adjoined by preferably rectilinear path segments. Specifically, the product to be transferred initially executes an upward motion which changes into a first inversion motion, in which the product is deflected transversely to the given path of motion above the other product. Once it is then at the level of the given path of motion of the other product, it is deflected again in the course of a further inversion motion, specifically in the direction of the given path of motion, and is preferably lowered downwardly at the same time, causing it to be placed upon the other product.

In a further feature of the invention, provision is made for the products to be transported by means of belt conveyors. The belt conveyors have revolving, beltlike runs on which the products rest. To bring about deflections and in particular to traverse curved paths, suitably shaped slide ways can be associated with the conveyor belts, so that the products are clamped between the slide way and the conveyor belt and transported in the desired direction in this way. It is also possible for the belt conveyors, at least in some regions, to receive the products between two conveyor belts, which preferably run parallel to one another, and to transport them in this received or clamping position along straight or curved paths.

In the loop-the-loop motion, provision is made in particular for the product arriving from the direction of the given path of motion to be made to rise and be transferred into an upside-down position in which, in the equivalent of a looping motion, it moves counter to the direction of the given path of motion and then, leaving the upside down position, to be transferred into a downward motion. In the course of the looping motion, a preferably continuous, lateral shift of the product takes place, in order to bring it from the position adjacent to the other product, i.e., side-by-side arrangement, into a position congruent with this other product.

In the flapping motion version, the one folding product, by means of a 180° flapping or foldover motion about a side edge thereof extending in the direction of the given path of motion, comes to be stacked on the other product.

Alternatively, in the flapping motion version, it is also possible, however, for both folded products to be erected, each by means of a preferably 90° flapping motion about a side edge extending in the direction of the given path of motion, and as a result to be brought into mutual engagement congruently. The thus erected and mutually engaging folding products can then be flapped over jointly to assume a horizontal stacked position. Preferably, this again involves a 90° flapping motion. Naturally, however, other flapping angles for this motion are also possible; for example, the one folding product may be flapped over 30° and the other folding product 150°, in order to bring them together in an obliquely erected position. For bringing them into the horizontal position, a joint flapping motion about an angle of 30° or 150° should then be performed.

In the double inversion motion, to execute the first inversion motion, optionally with the interposition of a transport medium, in particular a conveyor belt, the one folding product is guided, preferably about 180° about a first deflector extending transversely to the given path of motion. As a result, the one product moves laterally towards the other product. To put both folding products into congruent position, the inverted folding product, to execute the second inversion motion, optionally with the interposition of a transport medium, in particular a conveyor belt, is then guided, preferably again 180° about a second deflector extending transversely to the given direction of motion, as a result of which it comes to be stacked on the other folding product.

Preferably, provision can be made for the folding products to be transported so that the respective fold thereof extends crosswise to the given path of motion, preferably at an angle of 90°, with the fold directed either in or opposite to the direction of motion along the given path. It is always important that when the two products are in the stacked position, their folds are congruent with one another, so that the desired end product is created, for example, in an ensuing joint longitudinal folding operation.

Other features which are considered as characteristic for the invention are set forth in the appended claims.

Although the invention is illustrated and described herein as a method for bringing together folded products, it is nevertheless not intended to be limited to the details shown, since various modifications may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENT

Figure 1:
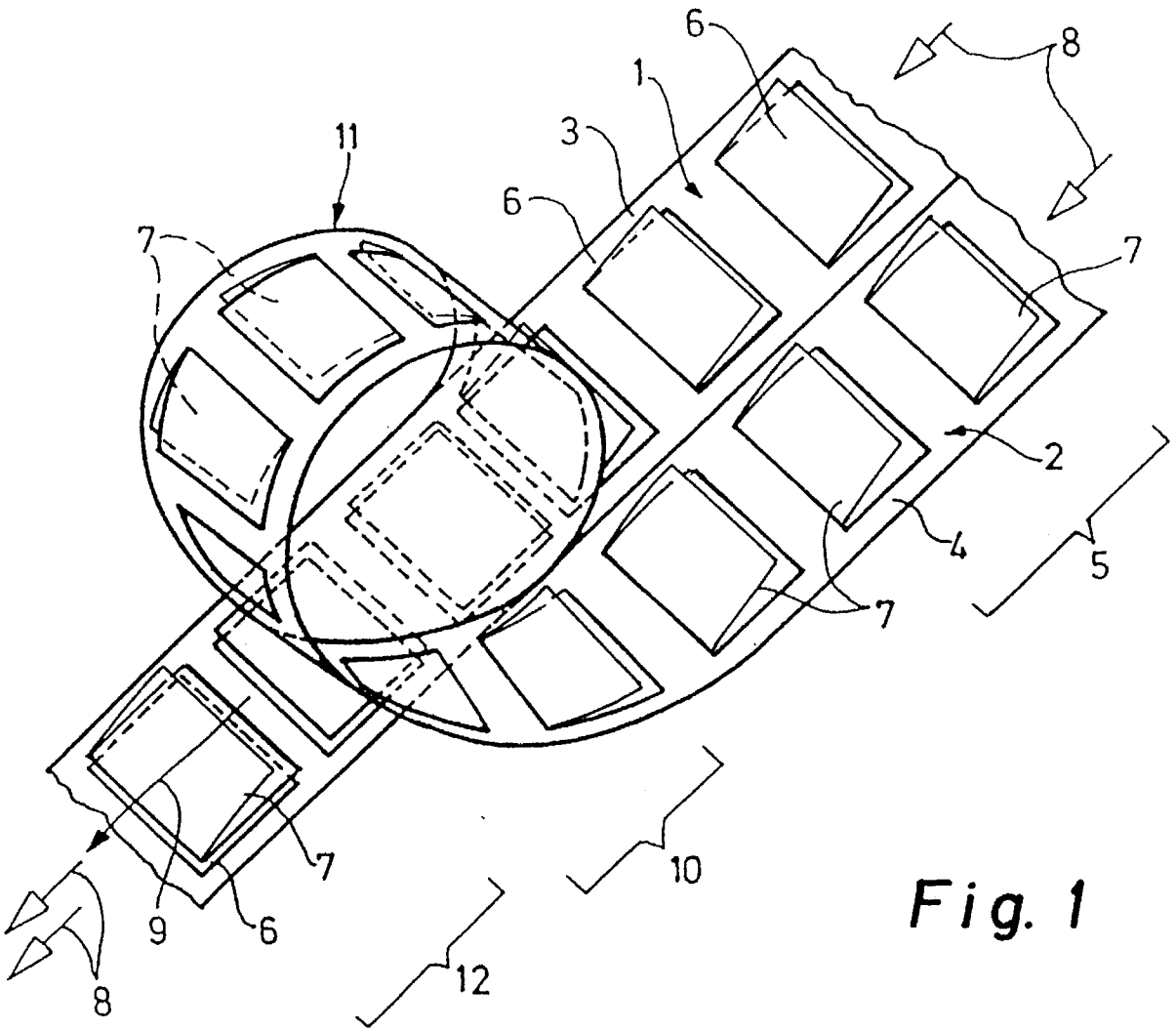
FIG. 1 is a diagrammatic view of transport media with which a looping transfer is performed in accordance with the method of the invention.

Referring now to the drawings and, first, particularly to FIG. 1 there is shown therein, in a diagrammatic view, a portion of a copy transfer device. This device has transport media 1 and 2, which are formed as conveyor belts 3 and 4. Because FIG. 1 is shown diagrammatically, the conveyor belts 3 and 4 are merely suggested in the drawing. In a first segment 5, they are disposed parallel to one another, in a side-by-side arrangement. Located thereon, likewise side by side and one after the other in rows, are products 6 and 7, respectively, provided with a cross-fold. These products 6 and 7 arrive from a non-illustrated folder which has two feed paths.

The conveyor belts 3 and 4 may have approximately the same width as the products 6 and 7 (as shown) or may be substantially narrower. Preferably, there is one narrow belt in each side region of the products 6 and 7. The conveyor belts 3 and 4 are formed as endless loops; they operate on the principle of a run or strand, such as of a conveyor belt. By non-illustrated conventional means, the conveyor belts 3 and 4 are placed in the desired form for forming a transport path with straight and curved regions. For example, suitable slide ways may be provided, along which the conveyor belts 3 and 4 travel. Various constructions of this kind are known from the prior art, so that this aspect need not be addressed in further detail.

The arrows 8 indicate the direction of motion of the conveyor belts 3 and 4. It is apparent that the conveyor belt 3 is moving along a path of motion 9 which has a rectilinear course. Within the first segment 5, the conveyor belt 4 likewise extends along a straight path parallel to the path of motion 9 of the conveyor belt 3.

In a second segment 10, the conveyor belt 3 traverses a looping path 11; that is, the products 7 resting thereon execute a loop-the-loop motion wherein, upon arriving from the direction of the conveyor path 9, they first rise and assume an upside down position in which they move counter to the motion of the path of motion and then, upon leaving the upside down position, they execute a downward motion.

Because the conveyor belt 4 in segment 10 has a continuous lateral offset, so that at the end of the looping path 11 it is congruent with and above the conveyor belt 3, the products 6 and 7 are transferred to coinciding positions; this means that they are located in congruent fashion, one above the other, in a third segment 12 adjoining the second segment 10, and their folds are likewise congruently one above the other. By suitable means, the conveyor belt 4 which remains located between the products 6 and 7 in the third segment 12 is then removed, so that the products 6 and 7 are stacked directly on one another. If the conveyor belt 4 is realized as two thin belts located in the side regions of the products, this conveyor belt 4 can be removed by spreading apart the belts, thus releasing the product 7. Alternatively, it is also possible, for example, to reverse the conveyor belt 4 around a deflection roller, so that the product 7 slides downward from the belt and rests in congruent fashion on the product 6.

Figure 2:
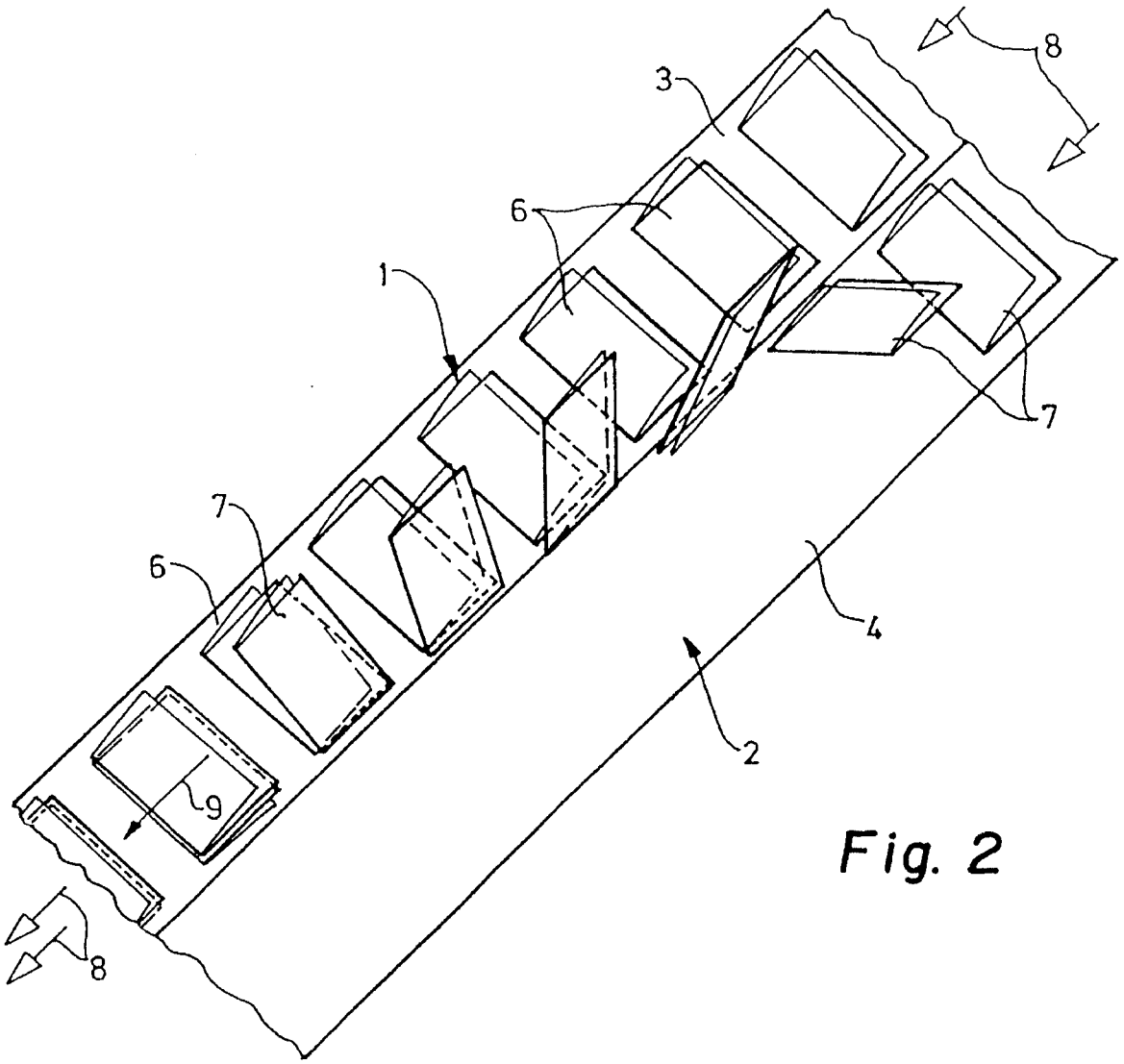
FIG. 2 is a diagrammatic view of transport media with which a flapping motion transfer is performed.

In FIG. 2, a flapping-motion version is presented, which means that the products 6 and 7 are placed one on the other by a flapping motion. In principle, the same remarks made hereinabove regarding the exemplary embodiment of FIG. 1 apply to this exemplary embodiment as well. However, the distinction exists that the two conveyor belts 3 and 4, in the region where the copies are transferred, extend parallel and rectilinearly to one another in a side by side arrangement. While the product 6 remains lying on the conveyor belt 3 with its position unchanged, the product 7 is folded about a side edge extending in the direction of the path of motion 9, by suitable means, such as a slide way, not shown, or moving conveyor means. A 180° flapping or hinged motion occurs so that the two products 6 and 7 rest on one another in congruent fashion. The cross-fold of the two products 6 and 7 is located either at the leading edge or the trailing edge of these products, which assures that the folds rest on one another after the flapping motion, as well.

In the course of the flapping motion, assurance must be provided that the product 7 is moved far enough towards the product 6 that the side edges of the two products 6 and 7 coincide. The possibility exists, for example, of forming a transverse groove, in particular with a concave bottom, on the transfer device in the region of the opposed side edges of the products 6 and 7; the two side edges of the two products 6 and 7 enter this groove and as a result slide together and meet one another. The result is that a clean, congruent stacked position is attained.

Alternatively, it is possible for the product 6 to be folded as well (not shown), for example, for both products 6 and 7 each to be erected by a 90° motion, whereupon in this erected position they face one another in congruent fashion. Thereafter, in the course of further transport or conveyance, the two products are folded or flapped together jointly, preferably through 90°, in order to place them in a horizontal lying position.

Figure 3:
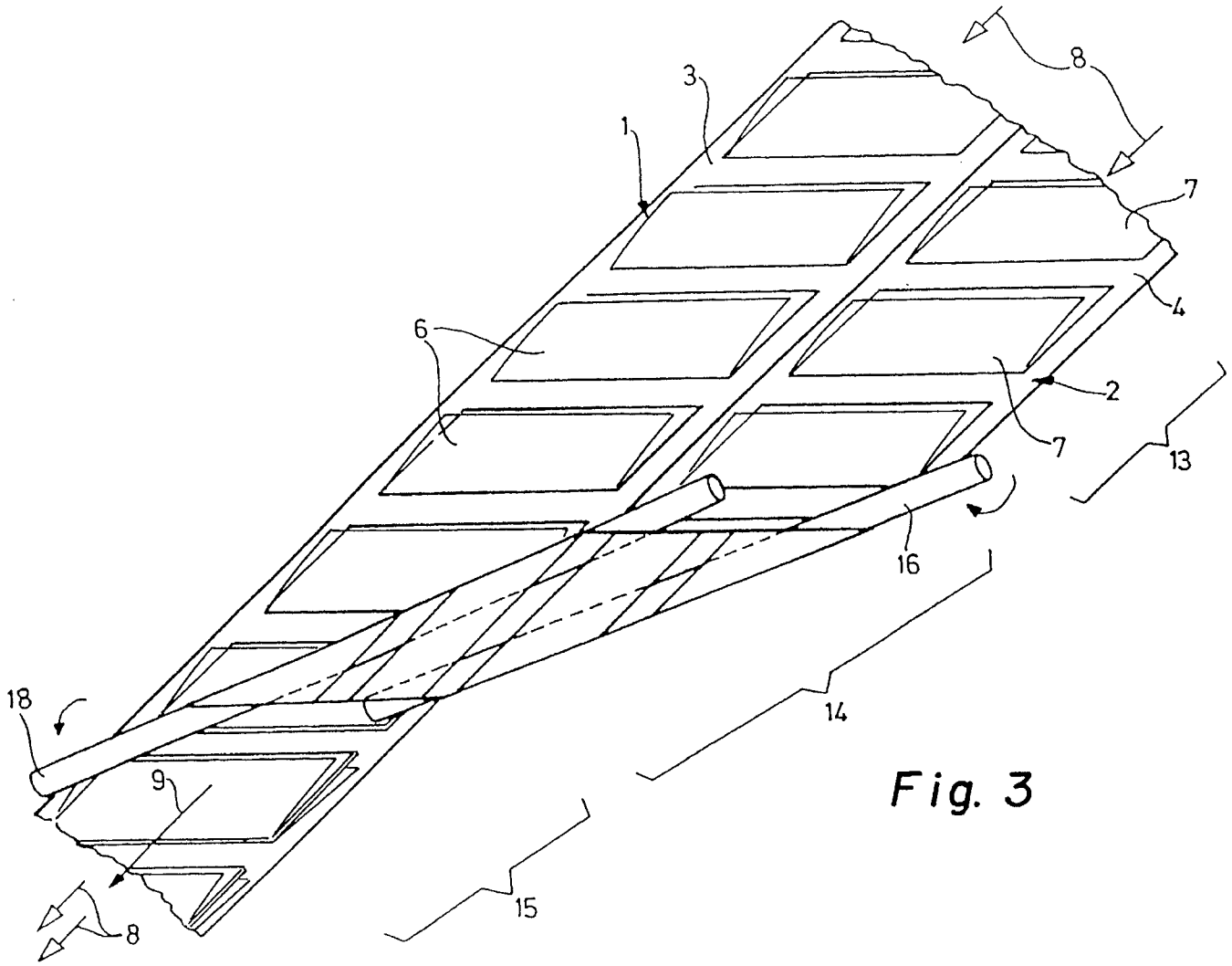
FIG. 3 is a diagrammatic view of transport media with which a double inversion or turning motion is performed.

In the exemplary embodiment of FIG. 3, a double inversion or turning action is explained. Once again, the comments regarding the exemplary embodiments of FIGS. 1 and 2 apply accordingly wherever features which are in common with all of the embodiments exist. As in the exemplary embodiment of FIG. 1, the conveyor belt 3 extends unchanged along a rectilinear path of motion 9. In a first segment 13, the conveyor belt 14 extends parallel to the conveyor belt 3, in a side by side arrangement. A second segment 14 then follows, in which a double inversion or turning motion is carried out. In a third segment 15, the conveyor belt 4 extends above and congruent with the conveyor belt 3.

Further details of the double inversion or turning motion is offered hereinafter. Located above the conveyor belt 4 in the second segment 14 is an inversion or turning bar 16, which extends obliquely at an angle to the direction of the path of motion 9. A second inversion or turning bar 18, which extends parallel to the inversion bar 16, is located above the conveyor belt 3, likewise in the second segment 4.

The conveyor belt 4, coming from below, wraps around the first inversion bar 16 and is thereby deflected transversely, preferably at an angle of 90°, to the path of motion 9. This takes place in a plane that is located higher than the level of the conveyor belts 3 and 4 in the region 13. Next, the conveyor belt 4 is then guided about the second inversion bar 18 in such a way that, once again, a 90° deflection takes place; that is, the conveyor belt 4 is deflected downwardly and simultaneously back again in the direction of the path of motion 9, so that the two conveyor belts 3 and 4 are located one above the other in congruent fashion.

Because of the oblique inversion or turning bars 16 and 18, the direction of motion of the conveyor belt 4 is changed, preferably by 90°, each time. At the same time, however, two 180° inversions of the belt 4 itself take place; that is, the products 7 located on the belt 4 are inverted by 180° at each inversion bar 16 and 18, so that a total motion of 360° occurs. The result is that the products 7 have the same position in the third segment 15 as in the first segment 13, but are now located above and congruent with the products 6. In the course of the further motion, the products 6 and 7 are then stacked on one another and can then be delivered jointly to a longitudinal folder.

If the individual products 6 and 7, respectively, follow one another too closely on the conveyor belts 3 and 4, it is then possible for every other product arriving from the cross-folder to be diverted by a suitable shunt, and in this way for a further system to be created in which the two products 6 and 8 move side by side at half the frequency. In such a case, also, suitable provisions for bringing the products together should be made, in accordance with the exemplary embodiments of FIGS. 1, 2 or 3.

The foregoing is a description corresponding in substance to German Application P 43 32 516.5, dated Sep. 24, 1993, the International priority of which is being claimed for the instant application, and which is hereby made part of this application. Any material discrepancies between the foregoing specification and the aforementioned corresponding German application are to be resolved in favor of the latter.

I claim:

1. A method for bringing together and stacking folded products which are guided along a given path of motion, which comprises transferring two folded products at a time from a side-by-side arrangement to a stacked position, and imparting a loop-the-loop motion to the one folded product so that it comes to be stacked on the other folded product.

2. The method according to claim 1, which comprises transporting the folded products on belt conveyors.

3. The method according to claim 1, which comprises, in the loop-the-loop motion, lifting the one product arriving from the direction of the given path of motion and transferring it into an upside-down position, wherein it moves counter to the direction of the path of motion, and then, in departing from the upside-down position, applying a downward motion to the one product, and laterally shifting the one folded product in the course of the loop-the-loop motion so as to bring the one folded product from a position thereof adjacent to the other product in the side by side arrangement into a position thereof congruent with that of the other product.

4. The method according to claim 1, which includes transporting the folded products with a cross-fold thereof oriented transversely to the direction of motion in the given path of motion.

5. A method for bringing together and stacking folded products which are guided along a given path of motion, which comprises transferring two folded products at a time from a side-by-side arrangement to a stacked position, and imparting a flapping motion to the one folded product so that it comes to be stacked on the other folded product.

6. The method according to claim 5, which includes applying a flapping-over motion through 180° to the one folded product about a side edge thereof extending in the direction of the given path of motion, so that the one folded product comes to be stacked on the other folded product.

7. The method according to claim 5, which includes applying a flapping motion to both of the folded products about respective side edges thereof extending in the direction of the given path of motion, so that the folded products are brought congruently into engagement with one another.

8. The method according to claim 7, which includes applying the flapping motion to each of the folded products through 90°.

9. The method according to claim 7, which includes flapping over the erected, mutually engaging folded products jointly into a horizontal position.

10. The method according to claim 9, wherein the erected, mutually engaging folded products are jointly flapped over through 90°.

11. The method according to claim 5, which comprises transporting the folded products on belt conveyors.

12. The method according to claim 5, which includes transporting the folded products with a cross-fold thereof oriented transversely to the direction of motion in the given path of motion.

13. A method for bringing together and stacking folded products which are guided along a given path of motion, which comprises transferring two folded products at a time from a side-by-side arrangement to a stacked position, and, in the course of applying a first inversion motion to one of the folded products, deflecting the one folded product transversely to the given path of motion and above the other of the folded products and, in the course of applying a second inversion motion thereat, deflecting the one folded product back into the direction of the given path of motion and downwardly onto the other folded product.

14. The method according to claim 13, wherein the performance of the first inversion motion includes guiding the one folded product about a first deflector extending transversely to the given path of motion, and the performance of the second inverse motion includes guiding the one folded product about a second deflector extending transversely to the given path of motion.

15. The method according to claim 14, which includes interposing transport of the one folded product by a transport medium when guiding the one folded product about the first and the second deflectors.

16. The method according to claim 13, which comprises transporting the folded products on belt conveyors.

17. The method according to claim 13, which includes transporting the folded products with a cross-fold thereof oriented transversely to the direction of motion in the given path of motion.

* * * * *